United States Patent [19]

Ando

[11] 4,020,969

[45] May 3, 1977

[54] LID OF A RECEPTACLE FOR INSTANT COOKING FOOD

[75] Inventor: Koki Ando, Osaka, Japan

[73] Assignee: Nissin Shokuhin Kaisha, Ltd., Osaka, Japan

[22] Filed: Mar. 24, 1976

[21] Appl. No.: 669,974

[30] Foreign Application Priority Data

| | | |
|---|---|---|
| Apr. 18, 1975 | Japan | 50-53567[U] |
| Apr. 24, 1975 | Japan | 50-56681[U] |
| May 19, 1975 | Japan | 50-67406[U] |

[52] U.S. Cl. ..... 220/265; 220/90.2; 220/256; 220/359; 229/7 R; 229/43

[51] Int. Cl.[2] ..... B65D 41/02; B65D 41/32

[58] Field of Search ..... 220/90.2, 90.4, 256, 220/257, 258, 265, 266, 359; 229/7 R, 43; 222/541

[56] References Cited

UNITED STATES PATENTS

| | | | |
|---|---|---|---|
| 3,391,847 | 7/1968 | Christine et al. | 220/257 X |
| 3,792,798 | 2/1974 | Chang | 220/90.2 |

*Primary Examiner*—George T. Hall
*Attorney, Agent, or Firm*—Wenderoth, Lind & Ponack

[57] ABSTRACT

A lid for a receptacle containing instant-cooking foods. The lid has an upper layer attached to a lower layer, and one of the layers is either perforated to be easily rupturable or has at least one opening therethrough. Furthermore, the upper layer has at least one portion extending beyond the edge of the lower layer.

12 Claims, 16 Drawing Figures

LID OF A RECEPTACLE FOR INSTANT COOKING FOOD

This invention relates to a lid or cover for a receptacle for instant cooking-foods, especially pilaf, curried rice, "chicken and rice" or chow mein.

BACKGROUND OF THE INVENTION

Most pre-cooked foods widely used in instant-cooking food products are charged into a receptacle after being dried. In preparation for consumption, hot water is poured over the food in the receptacle to reconstitute it into an edible food product.

This instant-cooking food consisting of a principal food, subsidiary foods and several kinds of seasonings all dried and mixed is restored with hot water; the hot water will be eaten as soup containing the seasonings. When the hot water is to be poured off, a portion of the lid is peeled from the receptacle to form an opening through which the hot water can be poured. The peeled portion of the lid can again be closed to keep the foods hot and thereafter be removed to consume the contents of the container. Thus, no special considerations are necessary for the lid, which may normally be formed from any flexible material easily peeled from the receptacle, such as a single sheet of paper, synthetic resin film, aluminum foil, or a laminated layer in which these materials are suitably combined.

Some kinds of instant-cooking food, however, require hot water only for restoration or reconstitution and are properly prepared for consumption only after as much of the hot water as possible is removed from the reconstituted foods. In this instance, a portion of the lid is peeled from the receptacle to form an opening to pour hot water into therethrough. The peeled portion of the lid is again closed to keep the foods hot, and the hot water will be removed after the food is restored. When the water is removed through the opening by tilting the receptacle, the consumer must hold the lid by his fingers during removal of the hot water to keep a small gap between the receptacle and the peeled portion of the lid so that the foods may not flow out through the opening. However, it is difficult and unpractical for fingers to hold the flexible lid to provide the narrow passage only for the water, without allowing for equalization of air pressure.

SUMMARY OF THE INVENTION

It is an object of the present invention to provide an improved lid which can be easily peeled from a receptacle, thus permitting hot water to enter it.

It is another object of the present invention to provide a lid through which no solids can be removed, but through which water will flow.

The lid in accordance with the invention is made of paper lined with aluminum foil which, more precisely, is sandwiched by sheets of synthetic resin film. The lid hermetically seals the top of a receptacle charged with dried food and is formed with a tongue at the periphery. The area to be opened for removing hot water is indicated adjacent the periphery of the lid, said area being adapted to be easily cut off or bored.

BRIEF EXPLANATION OF THE DRAWINGS

Other objects and further understanding of the present invention will be evident from the following detailed description of the invention and the scope of the claims when taken in conjunction with the accompanying drawings which illustrate the present invention.

In the drawings.

DETAILED DESCRIPTION OF THE INVENTION

Figure 1:
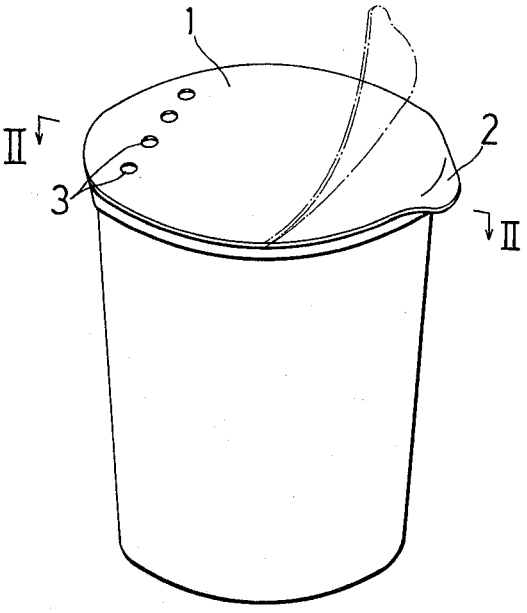
FIG. 1 is a perspective view of one embodiment of a lid in accordance with the present invention installed on the receptacle, the peeled portion of the lid being shown by broken lines.
Figure 2:
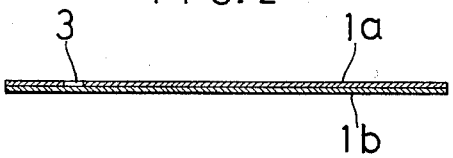
FIG. 2 is a sectional view of the first embodiment taken on line 2—2 of FIG. 1.

A lid 1 in the first embodiment shown in FIGS. 1 and 2 has an integral tongue 2 which is grabbed and lifted when the lid is opened. A top paper layer **1*a* of the lid 1 is provided with small bores 3 at intervals adjacent its periphery opposite the tongue 2. These bores 3 are preferably aligned across the lid 1. A lower aluminum layer 1*b* is frail or fragile enough to be pierced by being pressed with a stick or other blunt object within or through the bores 3**, thus providing openings through which hot water may be poured and removed from the container.

Figure 3:
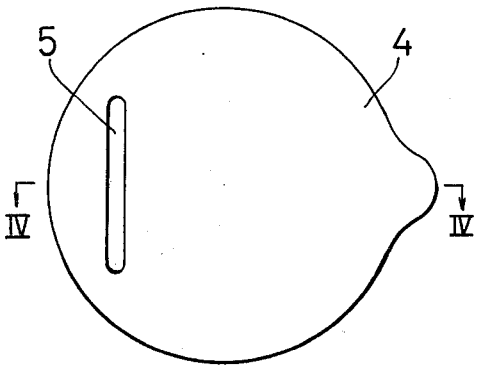
FIG. 3 is a top plan view of a second embodiment in accordance with the present invention.
Figure 4:
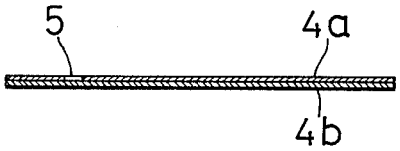
FIG. 4 is a sectional view of the second embodiment taken on line 4—4 of FIG. 3.

A lid 4 in the second embodiment shown in FIGS. 3 and 4 is similar in form to the lid 1 in the first embodiment. An upper sheet **4*a* is provided with a slot 5 extending along a line across the lid. During preparation for consumption, the portion of the lower sheet 4*b* corresponding to the slot 5** is partially or wholly pierced, whereby an opening for removing hot water is formed.

Figure 5:
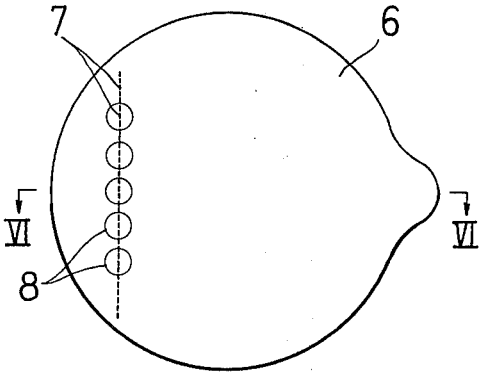
FIG. 5 is a top plan view of a third embodiment in accordance with the present invention.
Figure 6:
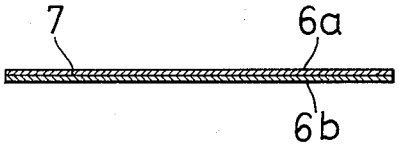
FIG. 6 is a sectional view of the third embodiment taken on line 6—6 of FIG. 5.

A lid 6 in the third embodiment shown in FIGS. 5 and 6 is similar in form to the lid 1 in the first embodiment. An upper layer **6*a* is perforated along a line 7 across the lid; indicia 8 may be printed on the line for indicating preferable positions for piercing around the perforations 7 merely for the consumers' convenience. During preparation for consumption, these sheets 6*a* and 6*b*** are pierced together, whereby openings for removing hot water are formed.

Figure 7:
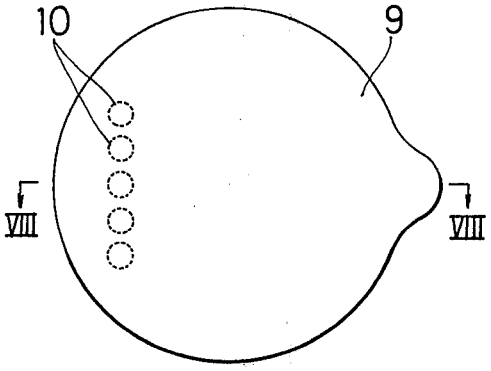
FIG. 7 is a top plan view of a forth embodiment in accordance with the present invention.
Figure 8:
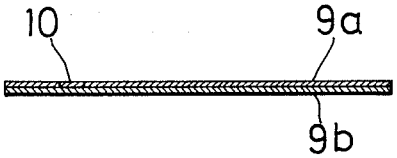
FIG. 8 is a sectional view of the fourth embodiment taken on line 8—8 of FIG. 7.

A lid 9 of the fourth embodiment shown in FIGS. 7 and 8 is similar in form to the lid 1 of the first embodiment, but an upper sheet **9*a* is perforated in circles 10 at the same positions as the small bores 3. During preparation for consumption, the sheets 9***a* and 9*b* are pierced at the circles 10, whereby openings for removing hot water are formed.

Figure 9:
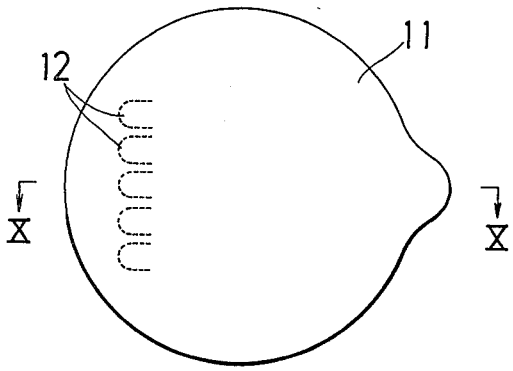
FIG. 9 is a top plan view of the fifth embodiment in accordance with the present invention.
Figure 10:
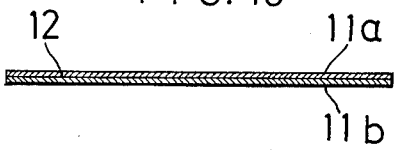
FIG. 10 is a sectional view of the fifth embodiment taken on line 10—10 of FIG. 9.

A lid 11 of the fifth embodiment shown in FIGS. 9 and 10 is similar to the lid 9 of the fourth embodiment and is provided at the same position and in the same direction as the circles 10 through an upper sheet 11*a* with U-shaped perforated lines 12. During preparation for consumption, the sheets 11*a* and 11*b* are pierced along these lines 12, whereby openings for removing hot water are formed.

Figure 11:
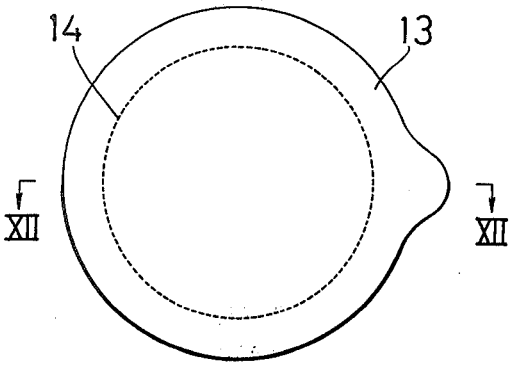
FIG. 11 is a top plan view of a sixth embodiment in accordance with the present invention.
Figure 12:
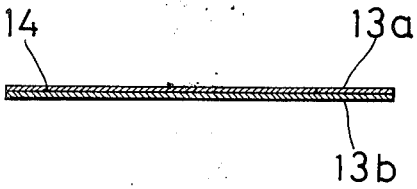
FIG. 12 is a sectional view of the sixth embodiment taken on line 12—12 of FIG. 11.

A lid of the sixth embodiment shown in FIGS. 11 and 12 is provided adjacent the periphery with an upper sheet 13*a* having a circular perforated line 14. During preparation for consumption, any portions of the upper and lower sheets 13*a* and 13*b* may be pierced along this perforated line 14, whereby openings for removing hot water are formed.

Figure 13:
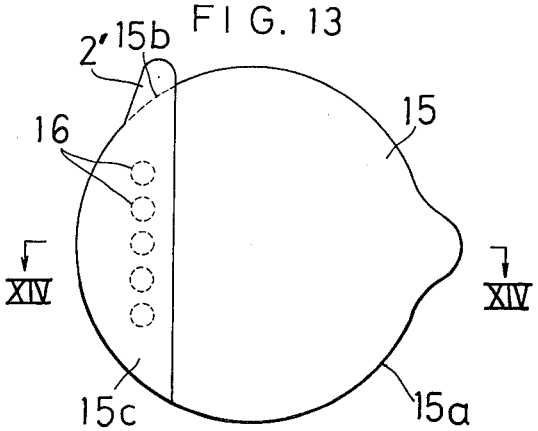
FIG. 13 is a top plan view of a seventh embodiment in accordance with the present invention.
Figure 14:
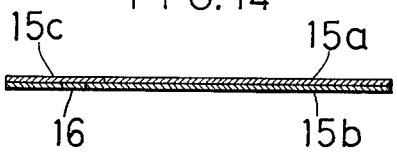
FIG. 14 is a sectional view of the seventh embodiment taken on line 14—14 of FIG. 13.

A lid 15 of the seventh embodiment shown in FIGS. 13 and 14 is similar in form to the lid 1 of the first embodiment and is provided with bores 16 at the same positions as the small bores 3 in FIG. 1 through a lower sheet 15*b*. A portion 15*c* of an upper sheet 15*a* is formed separately from the other part of the upper sheet 15*a* so as to cover said small bores 16, said portion 15*c* being removably adhered to the lower sheet 15*b*. During preparation for consumption, the portion 15*c* of the upper sheet 15*a* is removed by lifting a tongue 2', whereby the openings 16 for removing hot water are exposed.

Figure 15:
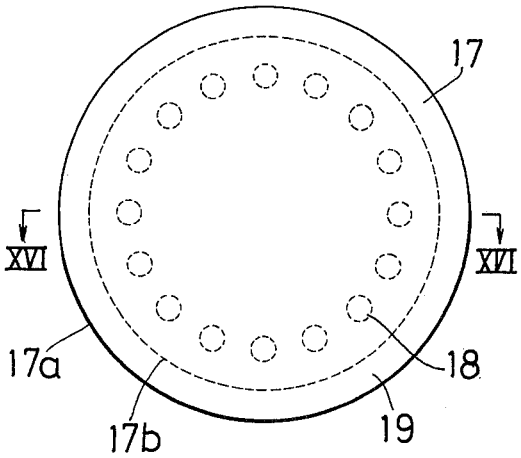
FIG. 15 is a top plan view of an eighth embodiment in accordance with the present invention.
Figure 16:
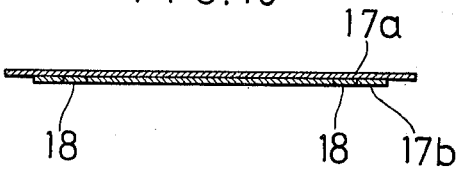
FIG. 16 is a sectional view of the eighth embodiment taken on line 16—16 of FIG. 15.

A lower layer 17*b* of the eighth embodiment shown in FIGS. 15 and 16 is perforated with circles 18 in a circle concentric with and near the edge of the lid 17. An upper sheet 17*a* is larger in diameter than sheet 17*b* and the container so that any portion of the edge 19 can be pulled to peel off the sheet 17*b*. The upper sheet 17*a* is removably adhered to a lower sheet 17*b*. During preparation for consumption, the upper sheet 17*a* is partially or wholly removed from the lower sheet 17*b*, whereby the openings 18 for removing hot water are exposed.

In all of the embodiments disclosed, the lid is fixed to the container by heat-sealing, adhesive or other suitable means.

As described in the embodiments in accordance with the present invention, hot water is poured onto the instant-cooking food in the container through an opening to restore the food, and the water is removed through another opening or openings after restoration. The opening or openings for removing the hot water can be provided without any troublesome operations by simply piercing predetermined portions on the lid having less strength than other portions thereof, or by removing an upper sheet constituting a lid. In addition, openings for removing hot water to be provided in the lid may be formed by small bores, through which no food within the receptacle may flow out while the hot water is being removed by tilting the receptacle.

Although preferred embodiments of the present invention have been described by way of example, it should be noted that variations and modifications thereof will be apparent in the form, method and/or constituting materials without departing from the scope and spirit of the present invention.

What is claimed is:

1. A lid for covering an opening in a receptacle containing items therein, said lid comprising:

a lower layer removable and hermetically sealed over said opening in said receptacle and having at least one portion thereof extending beyond the edge of said receptacle, whereby said lower layer can be lifted away from said opening in said receptacle by grabbing said portion thereof extending beyond the edge of said receptacle;

an upper layer attached to and covering said lower layer; and one of said layers having at least one opening therethrough, said opening being small enough to prohibit the items within said receptacle from passing therethrough.

2. A lid as claimed in claim 1, wherein:

said upper layer has a plurality of openings therethrough above said lower layer arranged in a line thereacross at a position distant from the center of said lid.

3. A lid as claimed in claim 1, wherein:

said upper layer has an elongated opening therethrough and positioned thereacross above said lower layer at a position distant from the center of said lid.

4. A lid as claimed in claim 1, wherein:

said upper layer is removably adhered to said lower layer.

5. A lid as claimed in claim 4, wherein:

said lower layer has a plurality of openings therethrough beneath said upper layer arranged in a circle concentric with the center of said lid.

6. A lid as claimed in claim 4, wherein:

said lower layer has a plurality of openings therethrough beneath said upper layer arranged in a straight line thereacross at a distance from the center of said lid.

7. A lid as claimed in claim 1, wherein:

said lower layer has a plurality of openings therethrough; and said upper layer is comprised of two portions, one of said portions being removably adhered over said openings in said lower layer.

8. A lid for covering an opening in a receptacle containing items therein, said lid comprising:

a lower layer removable and hermetically sealed over said opening in said receptacle and having at least one portion thereof extending beyond the edge of said receptacle, whereby said lower layer can be lifted away from said opening in said receptacle by grabbing said portion thereof extending beyond the edge of said receptacle; and an upper layer attached to said lower layer and having perforations therethrough above said lower layer.

9. A lid as claimed in claim 8, wherein:

said perforations in said upper layer are arranged in a straight line thereacross at a distance from the center of said lid.

10. A lid as claimed in claim 8, wherein:

said perforations in said upper layer are in the form of a plurality of circular shapes.

11. A lid as claimed in claim 8, wherein:

said perforations in said upper layer are in the form of a plurality of U-shaped figures.

12. A lid as claimed in claim 8, wherein:

said perforations in said upper layer form a single circular shape concentric with the center of said lid.

* * * * *